US010676884B2

(12) United States Patent
Kemmish

(10) Patent No.: US 10,676,884 B2
(45) Date of Patent: Jun. 9, 2020

(54) APPARATUS FOR ENHANCED SIGNPOST STABILIZATION

(71) Applicant: Kyle James Kemmish, Marco Island, FL (US)

(72) Inventor: Kyle James Kemmish, Marco Island, FL (US)

( * ) Notice: Subject to any disclaimer, the term of this patent is extended or adjusted under 35 U.S.C. 154(b) by 0 days.

(21) Appl. No.: 16/153,737

(22) Filed: Oct. 6, 2018

(65) Prior Publication Data

US 2020/0109529 A1 Apr. 9, 2020

(51) Int. Cl.
*E04H 12/22* (2006.01)
*E01F 9/685* (2016.01)
*E01F 9/681* (2016.01)

(52) U.S. Cl.
CPC ..... *E01F 9/685* (2016.02); *E01F 9/681* (2016.02); *E04H 12/2292* (2013.01)

(58) Field of Classification Search
CPC combination set(s) only.
See application file for complete search history.

(56) References Cited

U.S. PATENT DOCUMENTS 4,260,277 A * 4/1981 Daniels ..... E04B 1/2612 403/235
4,543,757 A * 10/1985 Cosgrove ..... E02D 27/42 248/158
5,244,172 A * 9/1993 Allega ..... E01F 9/669 248/161
5,794,395 A * 8/1998 Reed ..... E04F 11/1812 403/230
D398,219 S * 9/1998 Campman ..... D8/363
6,039,298 A * 3/2000 Stier ..... E04H 12/2215 248/156
6,334,287 B1 * 1/2002 Fick ..... E04B 1/355 16/226
6,446,409 B1 * 9/2002 Emerson ..... E04B 1/2608 403/232.1
7,048,462 B2 * 5/2006 Lanphier ..... E04F 11/1812 256/65.14
7,788,873 B2 * 9/2010 Leek ..... E04B 7/045 52/702
7,980,034 B2 * 7/2011 Fehr ..... E04C 3/30 248/519
8,528,275 B2 * 9/2013 Paananen ..... E04H 12/2215 52/155
8,959,849 B1 * 2/2015 DiGirolamo ..... E04B 5/10 52/182
D737,124 S * 8/2015 Sasanecki ..... D8/366
9,394,717 B2 * 7/2016 Paananen ..... E04H 17/22
2019/0376308 A1 * 12/2019 Tersigni ..... E04H 12/2292

* cited by examiner

*Primary Examiner* — Monica E Millner
(74) *Attorney, Agent, or Firm* — Lamon Patent Services; Cynthia Lamon

(57) ABSTRACT

A new signpost soil plate is disclosed. The invention being comprised of two main parts that are symmetrical. The two parts being L-shaped plates configured to receive a plurality of signposts when coupled together and increasing the resistance and force required to alter or tamper with said signposts An object of the invention is to provide multi-directional support to a standard signpost assembly therein.

7 Claims, 9 Drawing Sheets

FIG. I

APPARATUS FOR ENHANCED SIGNPOST STABILIZATION

FIELD OF THE INVENTION

The invention relates generally to sheet metal fabrication. More particularly, the present invention relates generally to a supplemental soil plates that are added to typical signposts.

BACKGROUND

Currently there are several solutions for signpost stabilization. Some of these solutions attempt to stabilize the signpost by adding bracket assemblies near the surface of soil/grade line, but these solutions fail to meet the needs of the industry because the current assemblies do not address the rotational, uplift or removal by non-authorized persons while maintaining the breakaway criteria mandated by the Federal Highway Administration. Other solutions attempt to enhance the resistance, but these solutions are similarly unable to meet the needs of the industry because they are installed at grade level and only provide minimal resistance due to the design, placement location and function of their current designs. For example: U.S. Pat. Nos. 5,396,743A and 4,928,446A teach of sign post anchoring systems having auger attachments to shore up existing posts. U.S. Pat. No. 5,058,337A disclosed a sign post anchoring system with spikes to support a sign post in the ground. U.S. Pat. No. 5,689,918 disclosed a sign post anchor with vertical wing members. Problematic issues continue with these current designs due to the wide assortment of signposts that differ in materials and configurations. Another current solution typically utilized in the industry is the use of concrete fill to enhance the rotational and uplift properties of the signpost.

Disadvantages of the current methods include, but are not limited to: weight of the concrete prior to installation, protection from the elements of the concrete prior to utilization, water requirement, metal reinforcement/anchors, loading/offloading of the concrete products and health warnings typically associated with utilization of concrete. The adverse effects of the supplemental concrete methodology are compounded after installation due to the sheer weight and mass of this assembly, require extensive excavation and potentially additional personnel and/or specialized equipment. A further issue to contend with is that the typical life expectancy of existing sign material that range from seven to twelve years and that the Federal Highway Administration has minimum threshold requirements that mandate replacement at specific intervals. The ongoing replacement consideration would be over and above any replacement program associated with damage or theft due to the proximity to the edge of roadway. In view of the foregoing disadvantages inherent in the known types of signpost soils plates now present in the prior art and practice, the present invention provides a new signpost soil plate construction wherein the same can be utilized for increasing the stability of a signpost by providing multi-directional support. The general purpose of the present invention, which will be described subsequently in greater detail, is to provide a new soil plate apparatus and method which has many of the advantages of the signpost plates mentioned heretofore and many novel features that result in a new post plate which is not anticipated, rendered obvious, suggested, or even implied by any of the prior art signpost ground anchors or soil plates, either alone or in any combination thereof.

SUMMARY OF THE INVENTION

To enhance sign post anchoring, the present invention is comprised of a signpost soil plate assembly. This assembly is comprised of two, identical, off set and elongated L-shaped plates. These plates are positioned at the bottom of, and perpendicular to, existing signposts while the posts are being installed in the ground. More specifically, the two plates are asymmetrical, elongated L-shaped wing members and are affixed to and extending outward from the lower portion of an existing signpost. Once attached to a signpost with fasteners and covered with soil, the plates prevent the sign from being pulled from the ground.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way. It is therefore an object of the present invention to provide a new signpost soil plate apparatus and method which has many of the advantages of the signpost ground anchors mentioned heretofore and many novel features that result in a new signpost stabilization soil plate which is not anticipated, rendered obvious, suggested, or even implied by any of the prior art signpost ground anchors, either alone or in any combination thereof. It is another object of the present invention to provide a new signpost soil plate which may be easily and efficiently manufactured and marketed.

It is a further object of the present invention to provide a new signpost soil plate which is of a durable and reliable construction. An even further object of the present invention is to provide a new signpost soil plate which is susceptible of a low cost of manufacture regarding both materials and labor, and which accordingly is then susceptible of low prices of sale to the consuming public, thereby making such signpost stabilization soil plate economically available to the buying public, Still yet another object of the present invention is to provide a new signpost soil plate which provides in the apparatuses and methods of the prior art some of the advantages thereof, while simultaneously overcoming some of the disadvantages normally associated therewith. Still another object of the present invention is to provide a new signpost soil plate for increasing the stability of a signpost by providing multi-directional support. Still yet another object of the present invention is to provide a new signpost soil plate that distributes the effect of torque caused by winds thereby preventing the swaying of road-side signs which can affect the visibility of the sign. Even still another object of the present invention is to provide a new signpost stabilization soil plate that can be used to provide stabilization in new sign installation as well as retrofitted to provide stabilization for existing signs. Yet another objective of the present invention is to provide a new signpost soil plate that increased the force required to dislodge, displace and/or remove road-side signs by non-authorized persons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

The invention will now be described more fully hereinafter with reference to the accompanying drawings, which are intended to be read in conjunction with both this summary, the detailed description and any preferred and/or particular embodiments and variations specifically discussed or otherwise disclosed. This invention may, however, be embodied in many different forms and should not be construed as limited to the embodiments set forth herein; rather, these embodiments are provided by way of illustration only and so that this disclosure will be thorough, complete and fully conveys the full scope of the invention to those skilled in the art.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features. The invention will be better understood and objects other than those set forth above will become apparent when consideration is given to the following detailed description thereof. Such description refers to the annexed drawings wherein.

Other aspects of the present invention shall be more readily understood when considered in conjunction with the accompanying drawings, and the following detailed description, neither of which should be considered limiting.

DETAILED DESCRIPTION OF THE PREFERRED EMBODIMENT

Figure 7:
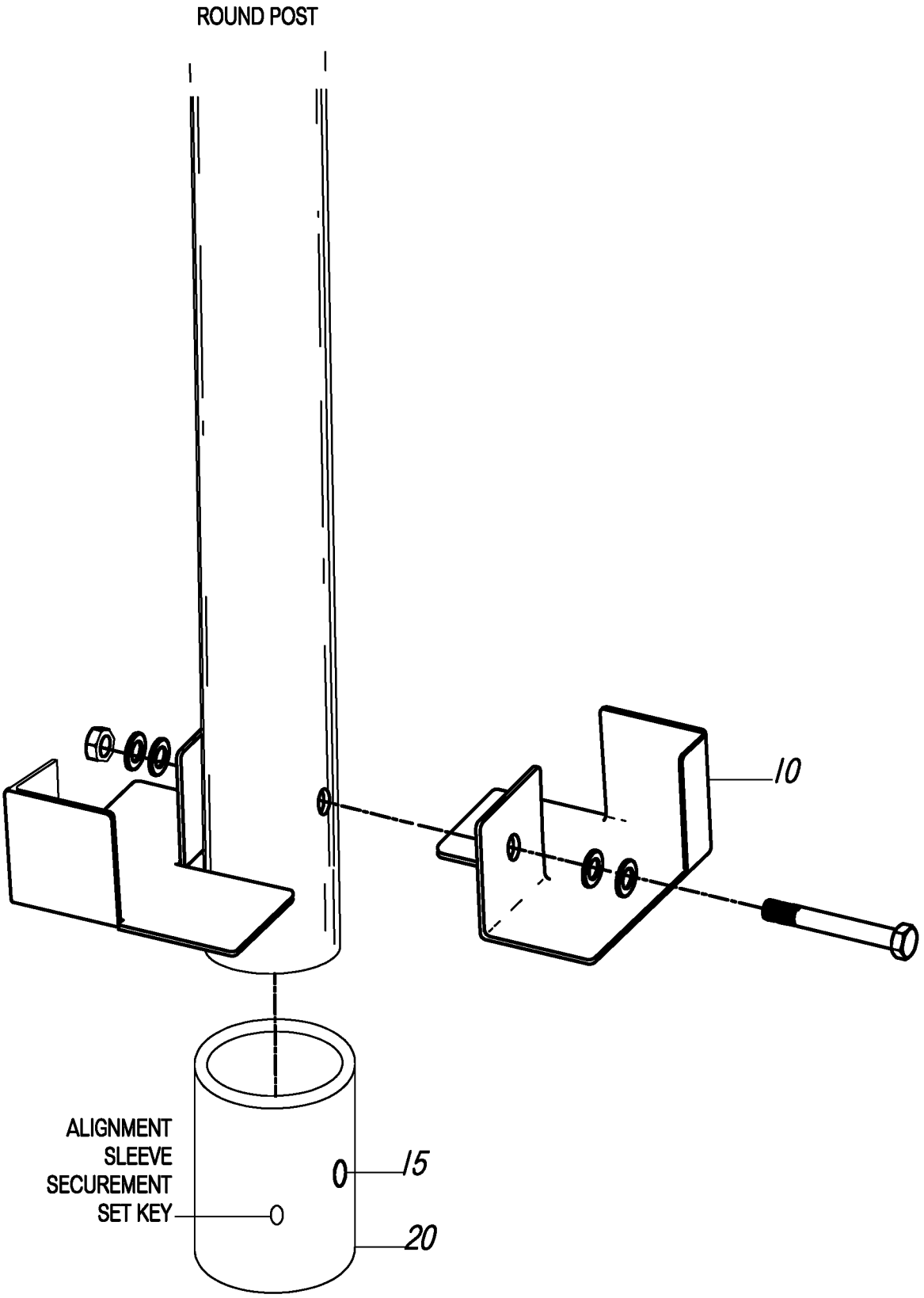
FIG. 7 is an illustration of the installation of the present invention on a round signpost.
Figure 8:
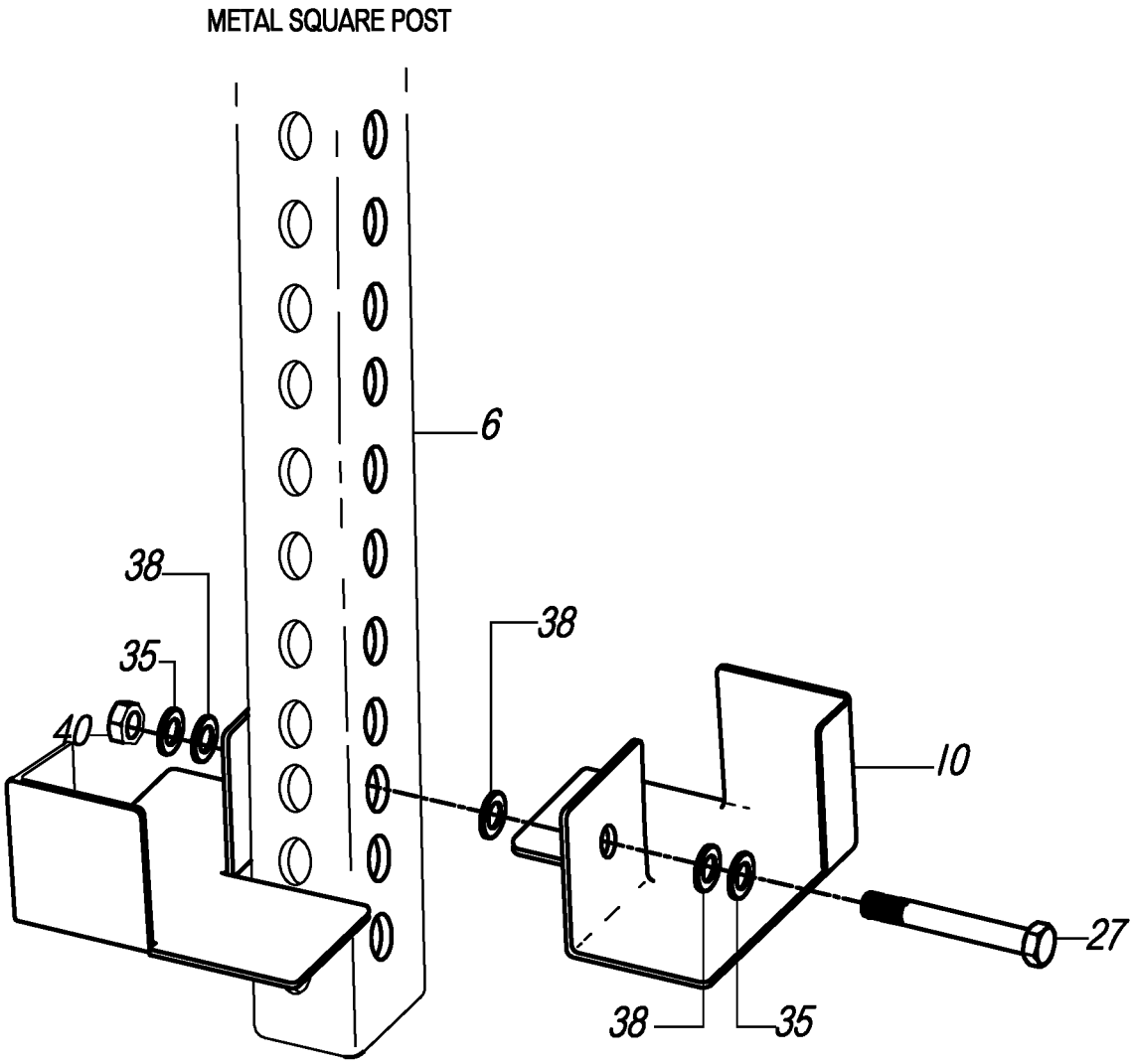
FIG. 8 is an exploded illustration of the installation of the present invention on a square metal signpost.

With reference now to the drawings FIGS. 1 through 8 thereof and in particular FIG. 8 which represents an exploded technical drawing of the new signpost soil plate, designated by the reference numeral 10, embodying the principles and concepts of the present invention and generally will be described. The utilization of this inventive device includes a self-positioning signpost soil plate assembly 10 that is installed onto a standard signpost irrespective of the material, shape, configuration or post assembly (single or multiple pieces) 6. More specifically, as detailed in FIG. 8 it will be noted that the signpost soil plate comprised of: a pair of elongated asymmetrical "L" shaped wing members 10 extend horizontally outward from the signpost 6 to provide multi-directional stabilization of the signpost 6 and installed below the surface of the ground G. The pair of elongated asymmetrical "L" shaped wing members 10 includes a pair of aligned mounting holes 15 for securing the elongated asymmetrical "L" shaped wing members 10 to the signpost 6 with a standard fastener assembly such as a bolt 27, steel fender washer 35 and nylon washer 38 and a lock nut 40 or a or lag screw, and steel fender washer 35 and nylon washer 3 as necessitated by the specific signpost utilized.

All fastener assembles shall be tightened as necessitated by field and signpost conditions. Each one of the pair of elongated asymmetrical "L" shaped wing members 10 extends horizontally outward from the signpost 6 at an angle of about 180 degrees to the other one. In addition, each one of the of elongated asymmetrical "L" shaped wing members 10 is bent at an angle along an imaginary vertical axis X so as to form adjacent multi-planar vertical walls. The wing angles are about 90 degrees so as to provide stabilization support in perpendicular/vertical planes. As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Figure 1:
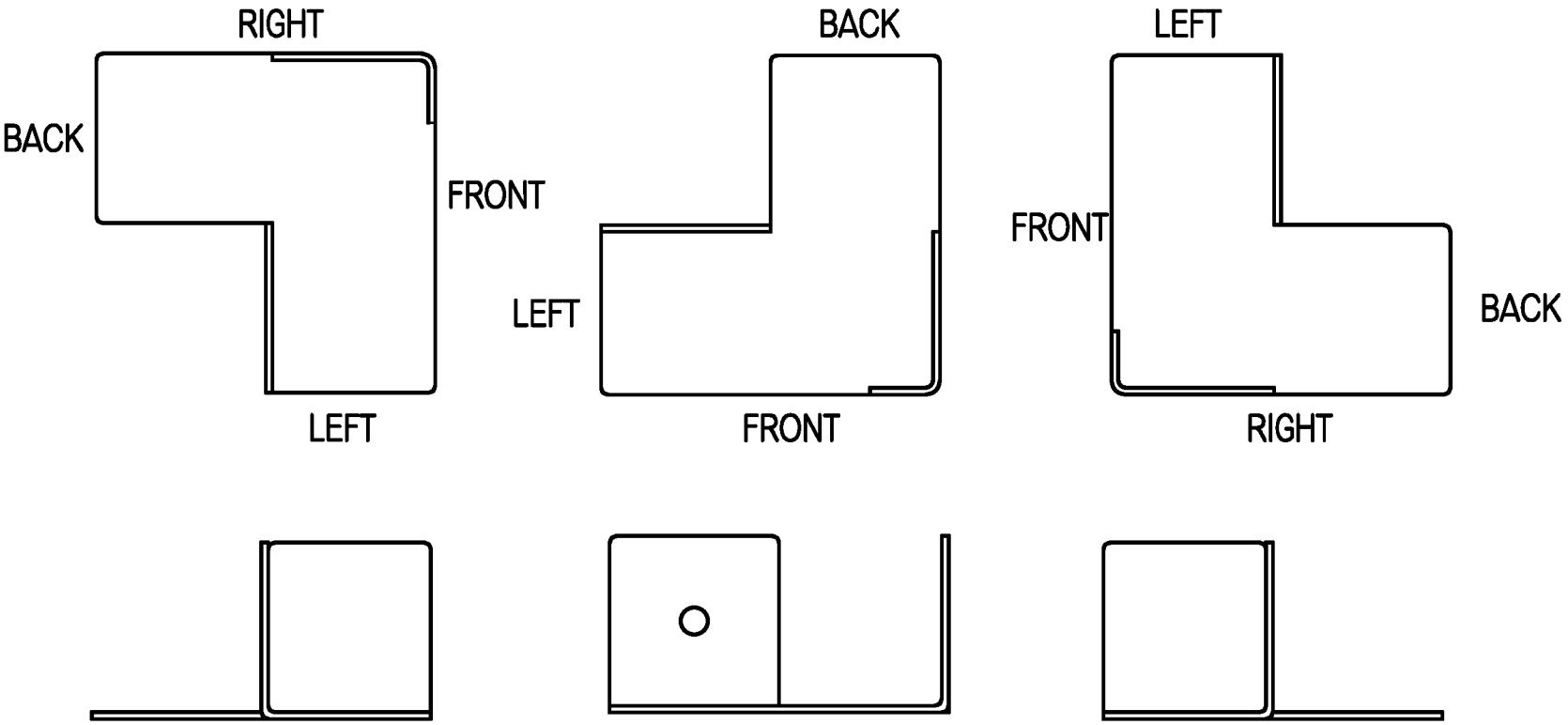
FIG. 1 is a technical illustration of the present invention in plan and elevation views.
Figure 2:
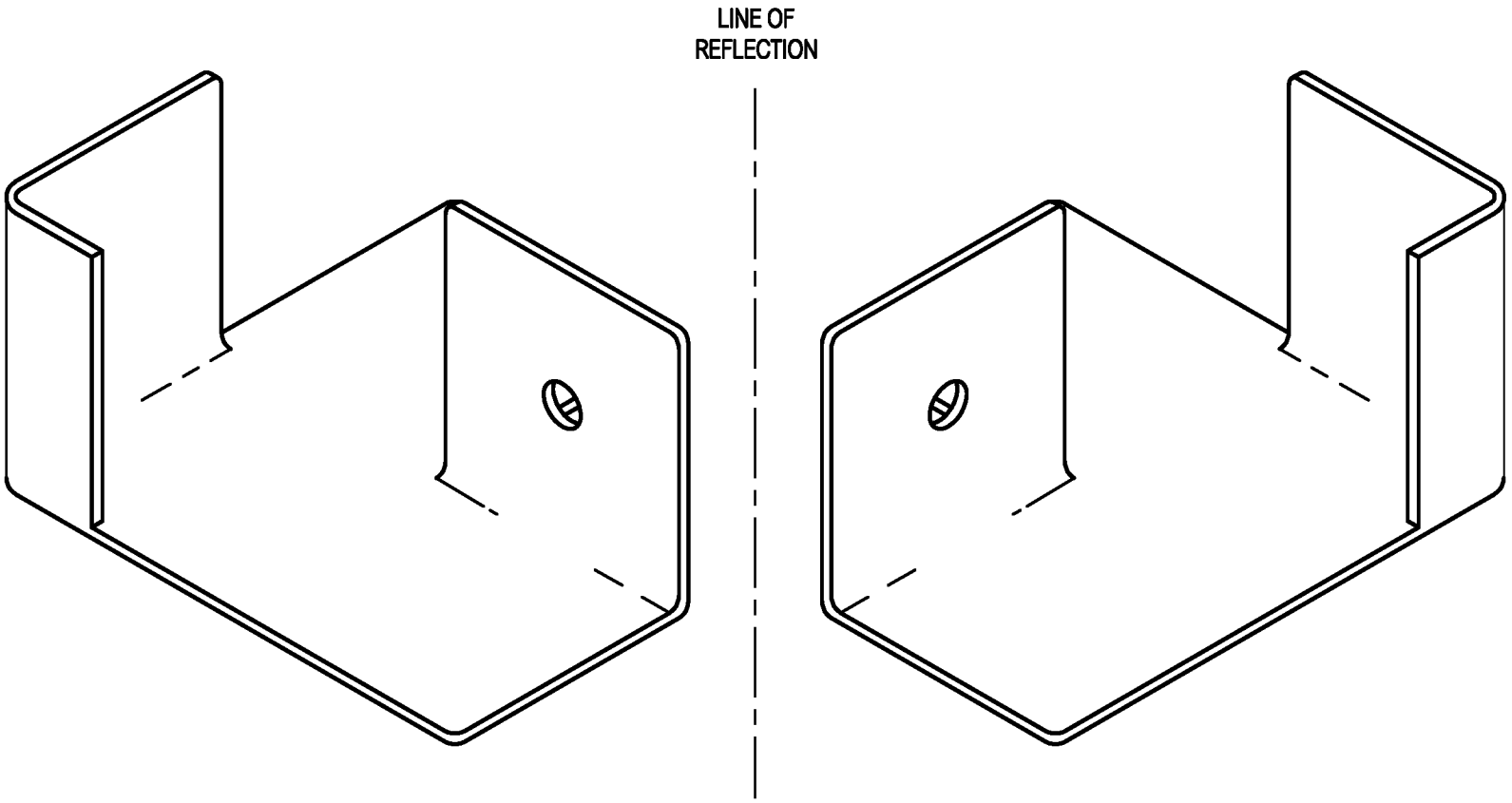
FIG. 2 is an illustration of the present invention in an isometric drawing.
Figure 3:
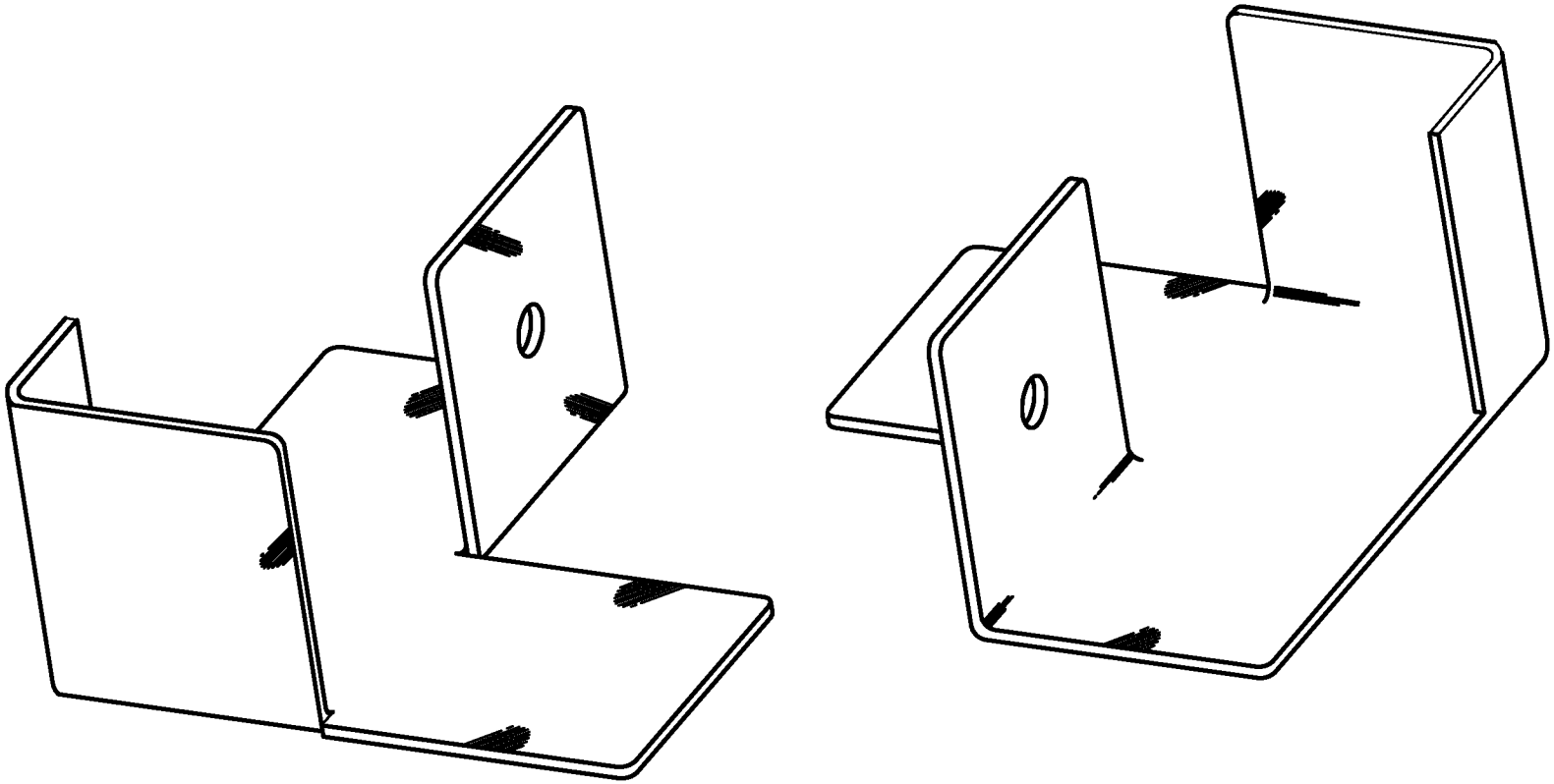
FIG. 3 is a shaded illustration of the present invention in three dimensions.
Figure 4A:
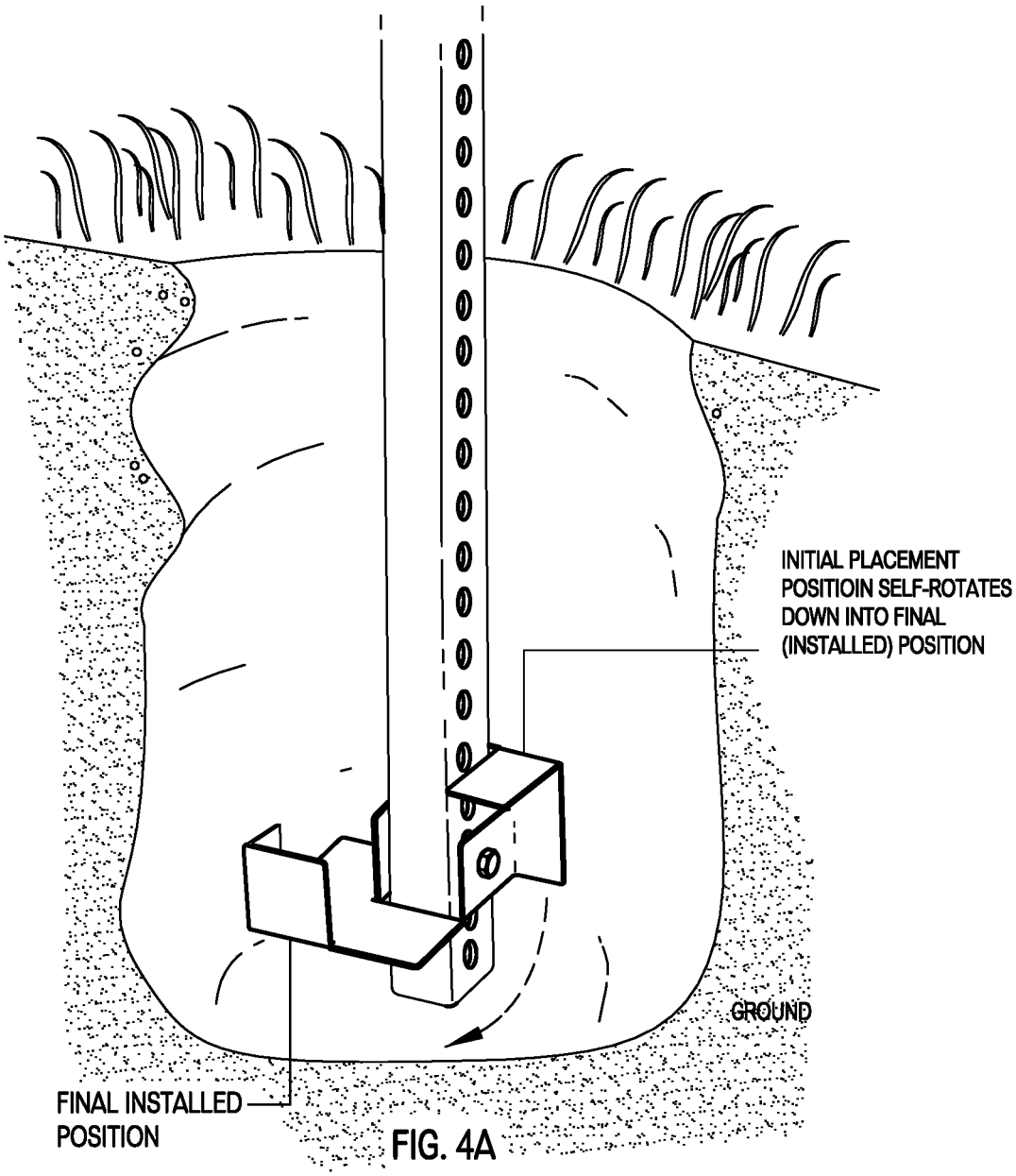
FIG. 4*a* is an illustration of the present invention designed for use with a square metal signpost detailing the soil plate assembly in an initial and final position.
Figure 4B:
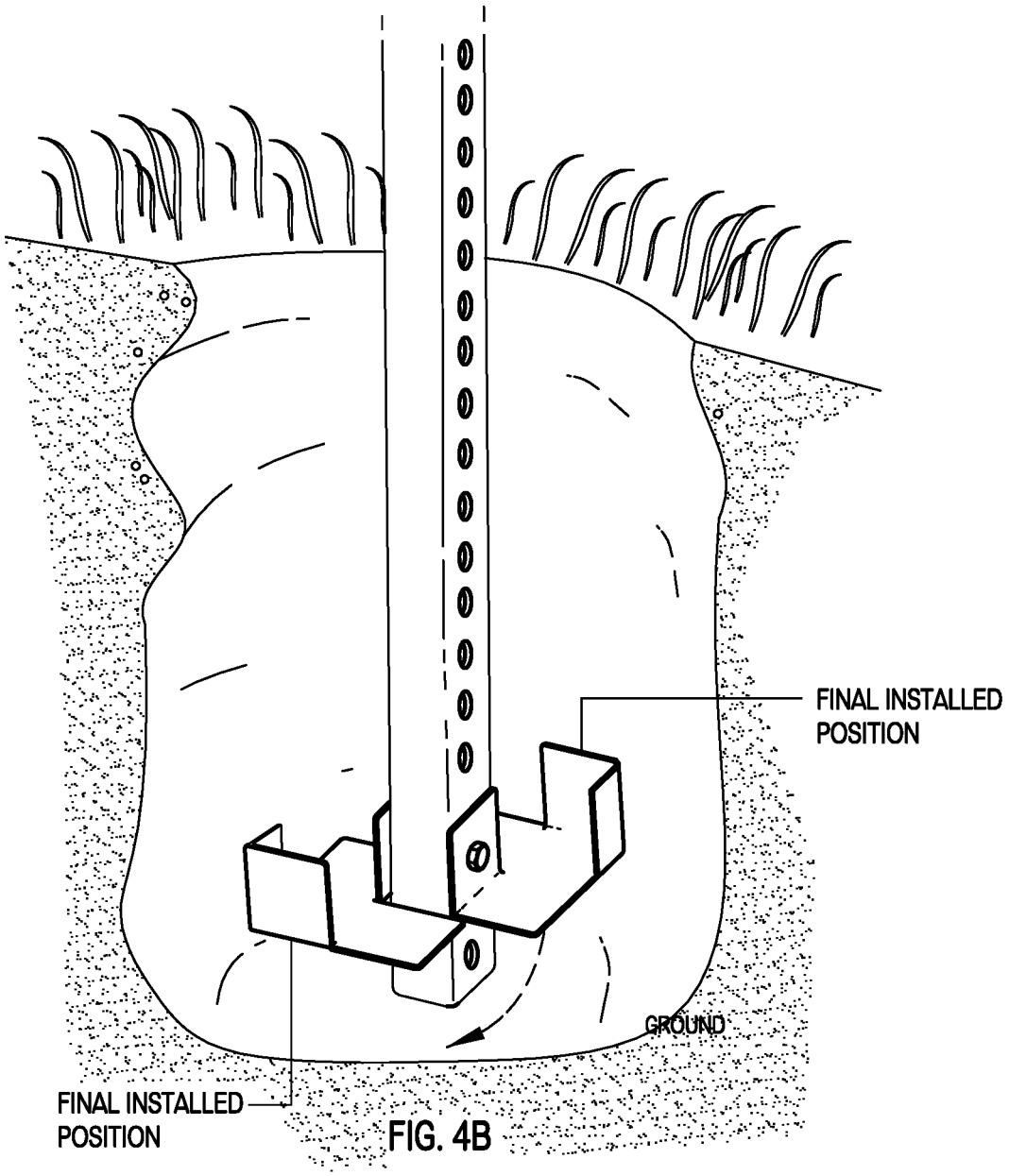
FIG. 4*b* is an illustration of the present invention designed for use with a square metal signpost detailing the soil plate assembly in its final position.
Figure 5:
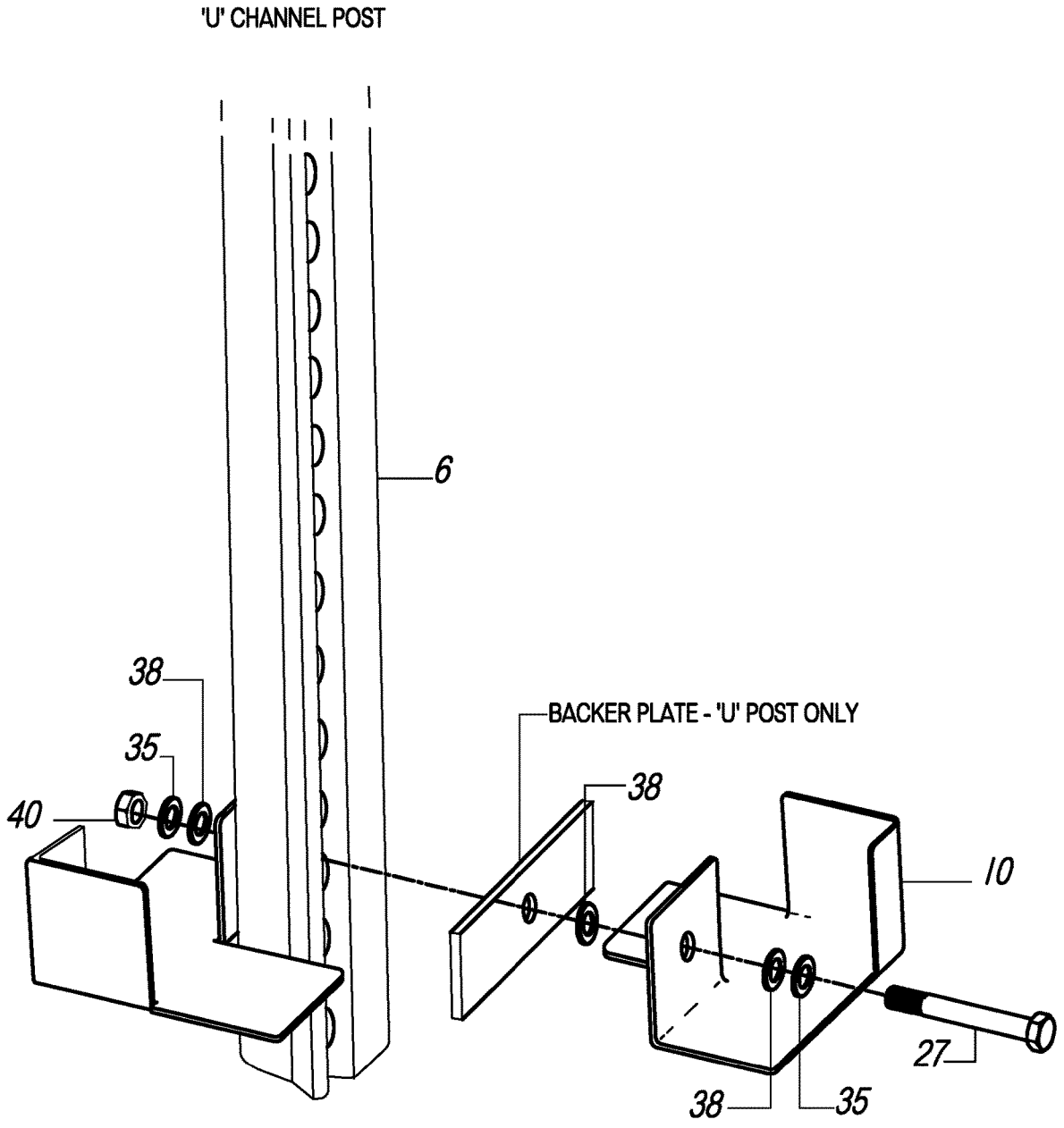
FIG. 5 is an illustration of the installation of the present invention on a metal "U" channel signpost.
Figure 6:
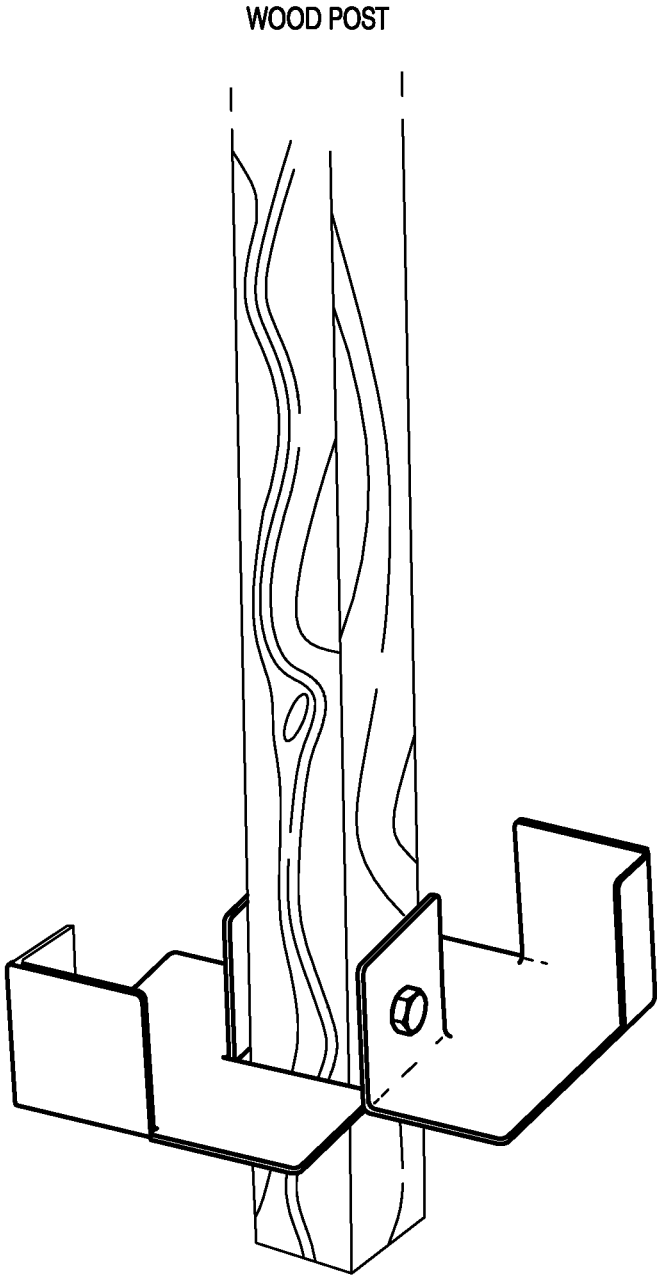
FIG. 6 is an illustration of the installation of the present invention on a square signpost.

Due to the wide assortment of commercially available signposts that differ in materials and configurations. Accessories that quicken and enhance the utilization of this new invention may be utilized: The backer plate assembly for "U" channel posts. FIG. 5 An alignment sleeve 20 for round posts to increase the accuracy and speed in installing the alignment holes in round posts. FIG. 7 Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. Signpost anchoring apparatus comprising:

two L-shaped plates, each having an inner length and width joining at an inner right angle, an outer length and width forming an outer right angle, including two ends; and a mounting wing plate formed via a 90 degree bend orthogonally adjacent to only the inner width of each L-shaped plate;

wherein with the mounting plates affixed to a vertical post, the L-shaped plates extend horizontally from the post and a length of the mounting plate is substantially equal to the inner width.

2. The signpost anchoring apparatus of claim 1, wherein the two L-shaped plates include a plurality of perpendicular wing plates formed on the outer length and width.

3. The signpost anchoring apparatus of claim 1, wherein the mounting plates include apertures to receive fasteners enabling mounting to the post.

4. A method of anchoring a vertical post in soil, the method comprised of the following steps:

(a) positioning two L-shaped plates around the sign post each L-shaped plate having an inner length and width joining at an inner right angle, an outer length and width forming an outer right angle, including two ends;

(b) securing the two L-shaped plates to the vertical post via a mounting wing plate formed on each L-shaped plate via a 90 degree bend orthogonally adjacent to the inner width of each L-shaped plate; and (c) preventing the post from being pulled from the ground via the two L-shaped plates extending horizontally from the post.

5. The method of claim 4, wherein the securing is accomplished via fasteners connecting the L-shaped plates to the post.

6. The method of claim 4, wherein the L-shaped plates each have an upper surface and an under surface, the upper surface pressing against the soil enabling the prevention of step (c).

7. The signpost anchoring apparatus of claim 1, wherein a length of the mounting plate is substantially equal to the inner width.

* * * * *